US007020910B1

(12) United States Patent
Horwood

(10) Patent No.: US 7,020,910 B1
(45) Date of Patent: Apr. 4, 2006

(54) PORTABLE SPA

(76) Inventor: Tim P. Horwood, 2815 Whispering Oak Ct., Chino Hills, CA (US) 91709

( * ) Notice: Subject to any disclaimer, the term of this patent is extended or adjusted under 35 U.S.C. 154(b) by 0 days.

(21) Appl. No.: 10/701,220

(22) Filed: Nov. 4, 2003

Related U.S. Application Data

(63) Continuation-in-part of application No. 10/606,605, filed on Jun. 26, 2003, which is a continuation of application No. 10/137,929, filed on May 2, 2002, now Pat. No. 6,584,624, which is a continuation of application No. 09/491,361, filed on Jan. 26, 2000, now abandoned.

(51) Int. Cl.
*A47K 3/00* (2006.01)

(52) U.S. Cl. ..... 4/541.1; 4/506

(58) Field of Classification Search ..... 4/541.1–541.5, 4/506

See application file for complete search history.

(56) References Cited

U.S. PATENT DOCUMENTS

| | | | | |
|---|---|---|---|---|
| 3,555,575 | A | 1/1971 | Schwartz et al. | 4/493 |
| 4,019,210 | A | 4/1977 | Patterson et al. | 4/492 |
| 4,110,852 | A | 9/1978 | Kline | 4/492 |
| 4,142,337 | A | 3/1979 | Holcomb | 52/169.7 |
| 4,233,694 | A | 11/1980 | Janosko et al. | 4/451.3 |
| 4,379,438 | A * | 4/1983 | Peardon | 119/702 |
| 4,661,247 | A | 4/1987 | Weir et al. | 210/97 |
| 5,056,167 | A | 10/1991 | Cholley | 4/492 |
| 5,199,116 | A | 4/1993 | Fischer | 4/451.2 |
| 5,224,224 | A | 7/1993 | Hintz et al. | 4/590 |
| 5,236,581 | A | 8/1993 | Perry | 210/130 |
| 5,718,007 | A | 2/1998 | Loyd | 4/541.1 |
| 5,727,264 | A | 3/1998 | Craig et al. | 4/489 |
| 6,058,521 | A | 5/2000 | O'Brien | 4/492 |
| 6,381,768 | B1 | 5/2002 | Herman | 4/541.1 |
| 6,584,624 | B1 * | 7/2003 | Horwood et al. | 4/541.1 |

* cited by examiner

*Primary Examiner*—Charles E. Phillips
(74) *Attorney, Agent, or Firm*—J. Mark Holland & Associates

(57) ABSTRACT

A portable spa comprises a reservoir for holding water and an outer wall spaced outwardly from the reservoir. The spa includes an equipment bay located between the reservoir and the outer wall that is accessible from an opening at a top portion of the spa. A cover over the opening to the equipment bay is removable from the top portion of the spa to permit access to the equipment bay. The equipment bay contains substantially all of the equipment necessary for operation of the spa and can be conveniently accessed free of any obstructions around the side of the spa. The spa can be installed either above ground in the manner of a portable spa, or it can be installed directly in the ground in the manner of a permanent in-ground spa. Reinforcing means comprising an internal support framework supports the spa against the lateral external forces generated as a result of in-ground installation.

22 Claims, 13 Drawing Sheets

FIG. 5
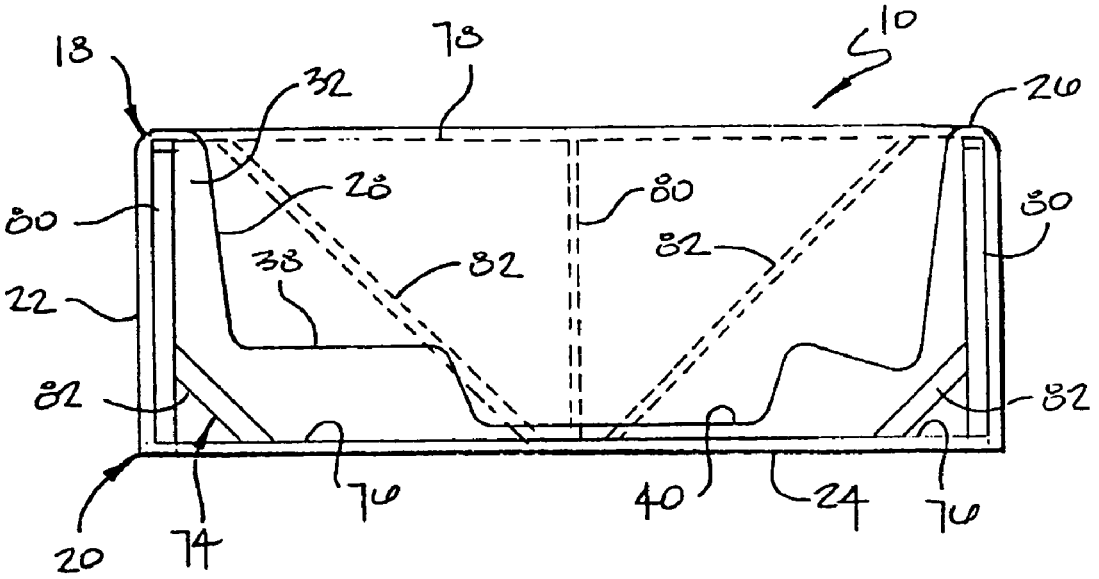
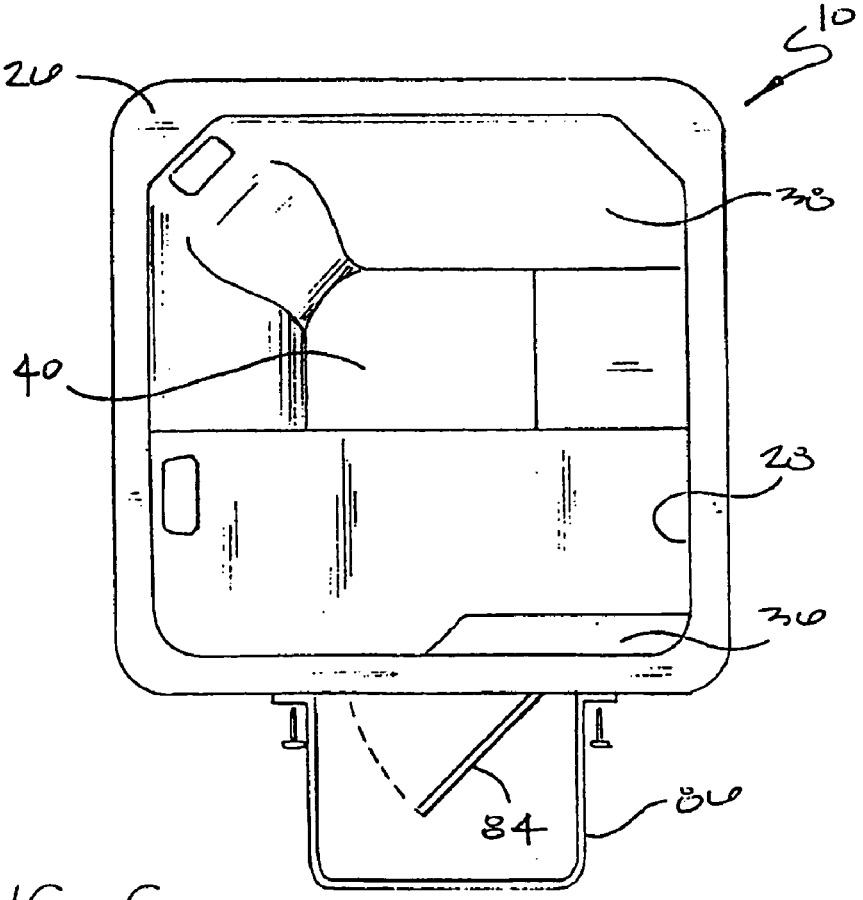
FIG. 6

PORTABLE SPA

This is a continuation-in-part of application Ser. No. 10/606,605, filed Jun. 26, 2003, which is a continuation of U.S. patent Ser. No. 10/137,929, now U.S. Pat. No. 6,584, 624 B2, filed May 2, 2002, which is a continuation of application Ser. No. 09/491,361 filed Jan. 26, 2000, now abandoned. Priority to the aforementioned applications is hereby expressly claimed in accordance with 35 U.S.C. §119 and 35 U.S.C. §120 and any other applicable statutes.

The contents of each of the aforementioned applications, and each U.S. patent and other reference, if any, cited in this application, are hereby incorporated herein by reference.

BACKGROUND OF THE INVENTION

1. Field of the Invention

The present invention relates to portable spas and, more particularly, to a spa which may be installed either in the ground or above the ground without hindering access to the technical equipment necessary for operation of the spa.

2. Description of the Related Art

Traditionally, there have been two distinct types of spas, permanent in-ground spas and portable spas that can be installed either above or below the ground. In-ground spas consist essentially of a shell installed in the ground that includes hydro-jets around its perimeter designed to circulate heated water within the spa. Plumbing to the hydro-jets must be installed underground and routed to the spa from a remote maintenance area which houses the necessary technical equipment, such as the pumps, heaters, filters and valves. While in-ground spas are generally considered more aesthetically pleasing than portable spas, they are also relative expensive and time consuming to install and are virtually impossible to remove and subsequently install at a different location.

Portable spas are usually stand-alone upright structures in which the water reservoir and all of the plumbing and technical equipment are within a single self-contained unit. These spas are advantageous in that they are easily installed above the ground without excavating the ground, and they can be moved to another location with little or no damage to the spa itself. Since portable spas are typically about three to four feet tall, a deck, or at least a set of stairs, is often built around the top of the spa to enhance the spa's appearance as well as provide easier accessibility for the user.

In some cases, owners of portable spas will install the spa below ground level to simulate the appearance of a permanent in-ground spa. However, the current industry rules governing underground installation of portable spas requires excavation of a hole larger than the spa itself, and the construction of a retaining wall or other suitable barrier to keep the pressure of the surrounding earth off the side walls of the spa. This undesirably adds to the installation expense and requires construction of a deck or the like to cover the gap between the top of the spa and the retaining wall.

Portable spas have traditionally provided access to the technical equipment (i.e., pumps, heater, etc.) through an equipment access door in one of the side walls of the spa. If the spa is installed above the ground, with a deck built around the spa, the deck must include a door or hole in one side to reach the spa's equipment access door. This has the disadvantage that it detracts from the appearance of the deck while increasing the expense. It also may be inconvenient to maintain or repair the spa's equipment, since one must crawl under the deck.

Similar disadvantages arise when a portable spa is installed below ground level. In these cases, the retaining wall in the excavated hole must be considerably wider than the spa itself to provide room to reach the spa's equipment access door at the side of the spa. Not only is the cover for this hole (in the deck between the spa and the retaining wall) usually unattractive, but the hole itself poses a potential safety hazard.

Accordingly, there has existed a definite need for a universal portable spa than can be installed either above the ground or below the ground, while simultaneously providing access to the technical equipment, and without sacrificing appearance and safety. There has also existed a need for a portable spa that is easier to install, repair and maintain. The present invention satisfies these needs and provides further related advantages.

SUMMARY OF THE INVENTION

The present invention provides a spa for use in heating and circulating water in the form of a self-contained unit having all of the equipment necessary for operation of the spa. The spa is capable of either above-ground installation in the manner of a portable spa or direct in-ground installation in the manner of a permanently installed spa. In either case, regardless of the manner of installation, access to the equipment for operation of the spa is convenient and not hindered in anyway.

The spa comprises a reservoir for holding water and an outer wall surrounding the reservoir. An equipment bay containing all of the equipment necessary for operation of the spa is located in and accessible from an opening of the top portion of the spa between the outer wall and the reservoir. A cover over the opening to the equipment bay is opened from the top portion of the spa to permit access to all of the equipment in the equipment bay. Thus, access to the equipment is provided in a safe and convenient fashion, free of any obstructions that may be around the outer wall at the side of the spa.

In one aspect of the invention, the opening to the equipment bay is provided in a substantially horizontal coping that joins the reservoir to the outer wall. When the cover is closed, it may be sealed to the opening in a substantially water-tight manner so that the equipment in the equipment bay, such as a heater, pump and related control equipment, can be free of water intrusion. The spa also includes a water filter in a filtration compartment normally flooded with water from the reservoir, and filter cartridges for filtering impurities from the water. The filtration compartment is normally separated from the equipment which may be housed in a separate equipment compartment, and the two compartments need not be covered by the same cover. However, for convenience, the two compartments may be located side-by-side and share a common cover.

In another aspect of the invention, reinforcing means are provided between the outer wall and the reservoir for supporting the outer wall against deformation from external forces. When the spa is installed below ground level, the reinforcing means withstands the external forces from excavated ground that is in direct contact with, and therefore applies pressure directly against, the outer wall. The reinforcing means may comprise a plurality of internal support elements, it may comprise a dense foam material, or it may comprise a combination of both.

In one embodiment of the reinforcing means, the support elements comprise a framework including a plurality of horizontal bottom support elements, a plurality of horizontal top support elements, and a plurality of vertical support elements that connect the bottom support elements to the top support elements. A plurality of bracing elements connected at an angle between the vertical support elements and the horizontal bottom support elements assist in supporting the framework and, thus, the outer wall against deformation from lateral external forces. This framework may be comprised of pressure-treated wood or other suitable materials.

In an alternative form of the invention, the opening to the equipment bay may be provided in the outer wall at a side of the spa. A shield is provided over the opening that can, like the reinforcing means, withstand deformation from external forces, for example, from the ground surrounding the spa. The shield is spaced from the opening such that the spa can be installed below ground level, and the equipment bay can be accessed by removing the cover over the opening.

The spa of the present invention is extremely versatile, as it can be installed either above ground or below ground level, while still providing a means to access the equipment necessary to operate the spa. Access to the equipment is both convenient and safe, and the overall appearance of the spa and its surrounding environment can be made to be as aesthetically pleasing as possible.

For example, if the spa is installed above the ground, a wood deck may be constructed around the spa, without requiring a side access door or a top access door in the deck, since access to the equipment bay can be reached from the top of the spa. Similarly, among other things, above abutment-grade connecting members permit sections of the spa to be joined and installed directly in the ground and the excavated earth can be applied directly to the side of the spa, to simulate the appearance of a permanent in ground spa. No retaining walls or other type of barriers are needed. Thus, the resulting spa has enhanced utility, as it may be portable or permanently installed at the option of the user. It is also relatively easy and inexpensive to install, repair and maintain, without any underground pipes and attendant problems from leaks or the like.

Other features and advantages of the present invention including cover, safety, and fluid control feature improvements will become apparent from the following description of the invention, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 5 is a side schematic view of the spa in which an internal support structure is illustrated in dashed lines.

FIG. 6 is a top plan view of a spa showing an alternative embodiment of the invention.

DETAILED DESCRIPTION OF THE PREFERRED EMBODIMENTS

Figure 1:
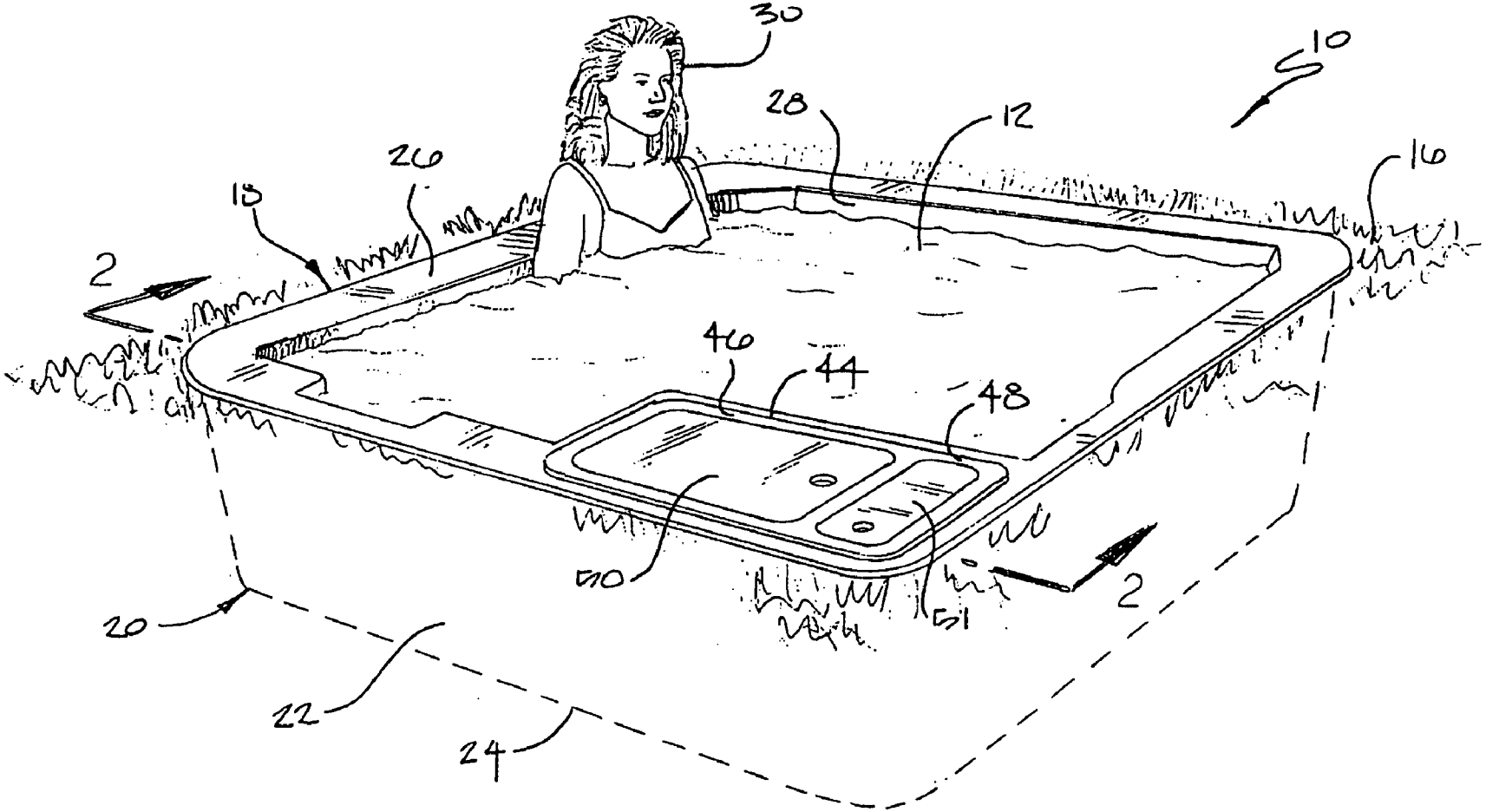
FIG. 1 is a perspective view of a portable spa embodying the present invention, showing the spa installed underground.

As shown in the accompanying drawings, the present invention is embodied in a spa, indicated generally by the reference numeral 10, for use in heating and circulating water 12 in the traditional manner. The spa 10 is capable of either above-ground installation, in which a raised deck 14 may be constructed around the spa, or direct in ground installation, in which the spa is installed in the ground 16 with the earth directly in contact with the side of the spa. In either case, access to the equipment required for service of the spa 10 is convenient and not hindered in any way by the manner of installation.

FIG. 1 shows the spa 10 installed directly in the ground 16. However, whether the spa 10 is installed in the ground 16, as in FIG. 1, or above the ground, as in FIG. 4, the basic structure of the spa is still the same. It is defined by a shell 18, which may be constructed of fiberglass, acrylic, high-impact thermoplastic materials, or any other suitable light-weight, high-strength material not easily susceptible to damage from water or sunlight. The shell 18 may be molded in a single unit, but more commonly it is a combination of several pieces joined together by adhesives or fasteners or by similar methods known in the art.

In one embodiment, the shell 18 comprises an outer wall 20 that defines the outer shape of the spa 10 and functions as a housing to enclose all of the remaining elements of the spa. In particular, the outer wall 20 comprises a vertical side wall 22 and a horizontal bottom wall 24. A horizontal coping 26 along the upper surface of the spa 10 provides a smooth transition from the vertical side wall 22 to an internal water reservoir 28 designed to hold a quantity of water 12 and at least one person 30.

Figure 2:
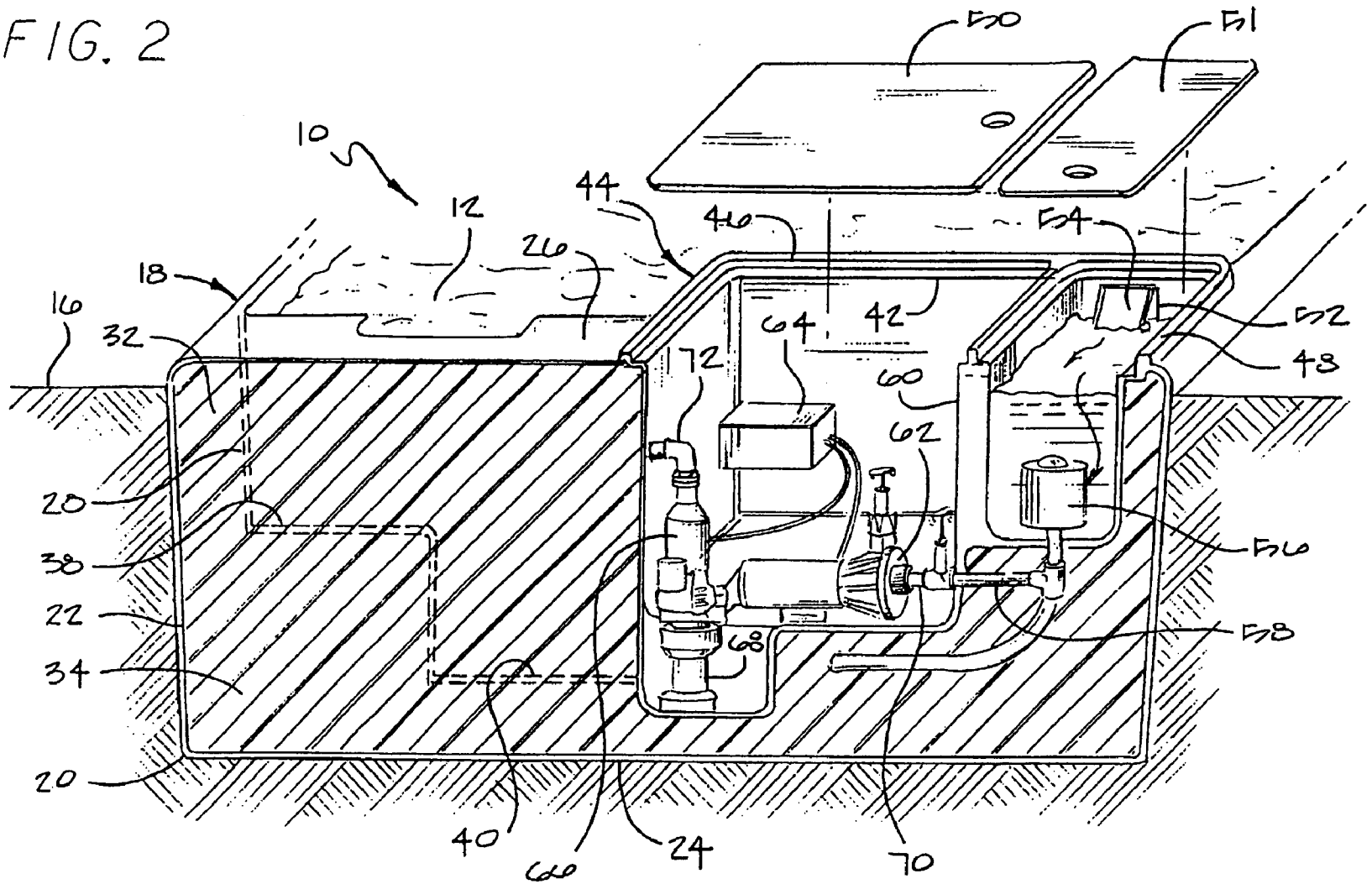
FIG. 2 is another perspective view of the spa, with a cross-section taken along the line 2—2 of FIG. 1, showing an equipment access door removed to permit access to the spa's technical equipment.

As shown in FIG. 2, a space 32 is provided between the outer wall 20 and the reservoir 28. This space 32 is preferably filled with a stiff insulating material 34, such as a dense Styrofoam or the like. The insulating material 34 increases the structural integrity of the spa 10, as well as its insulating qualities. Alternatively, as described below, some of the equipment required for service of the spa 10 may be provided in the inner space 32 between the outer wall 20 and internal water reservoir 28.

Figure 3:
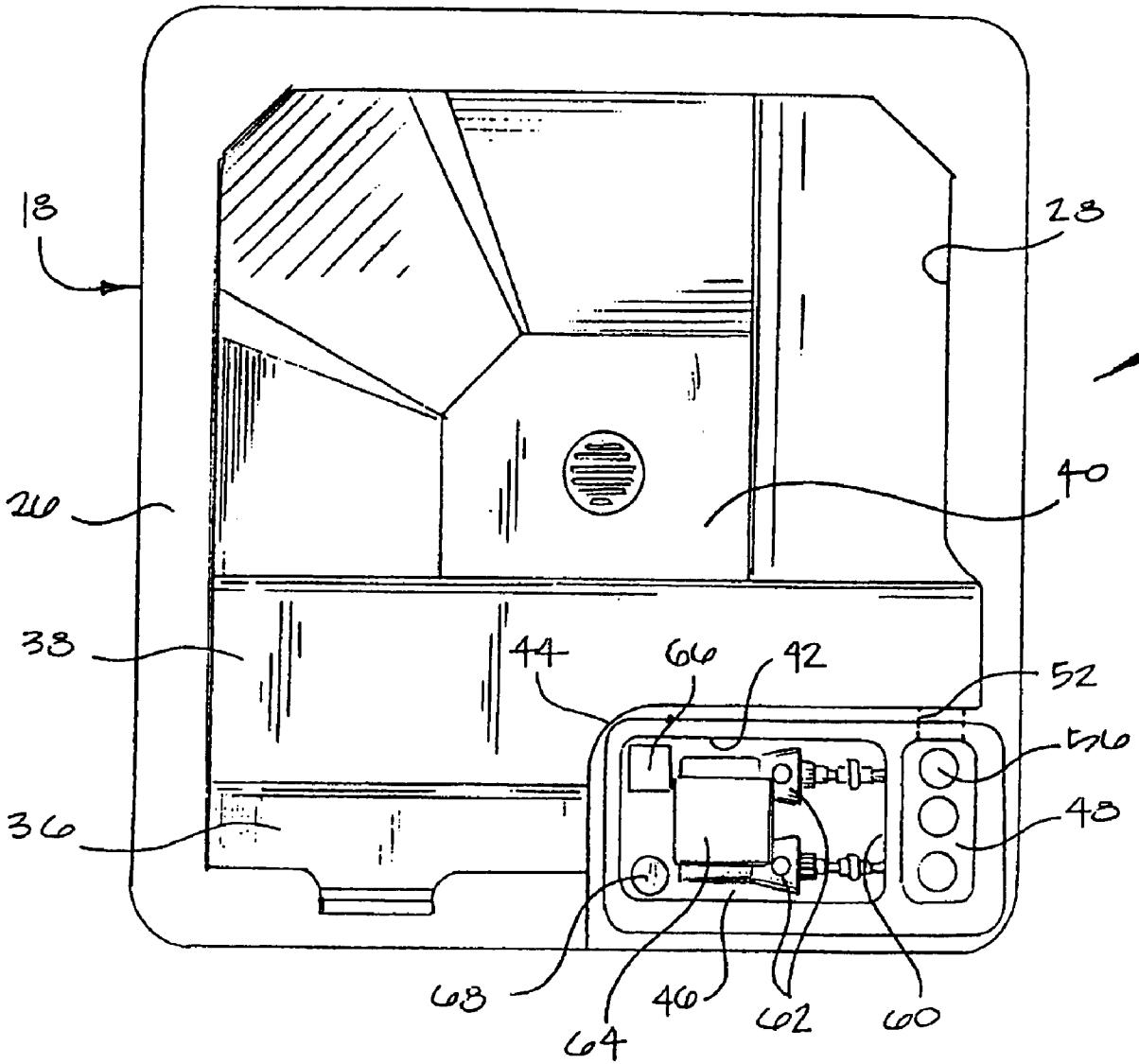
FIG. 3 is a top plan view of the spa.

With reference to FIGS. 2–3, a step 36 is included in the reservoir 28 for the user's ease and safety while entering the spa 10, and bench seats 38 are included for the user to sit or lounge in the water 12. A foot well 40 is also typically included in the center of the spa 10. Multiple hydro-jets (not shown) located around the perimeter of the reservoir 28 provide powerful streams of heated water that vigorously circulate the water 12 in the reservoir. It will be understood that the arrangement of the step 36, seats 38, foot well 40 (and hydro-jets) illustrated in the drawings is but one possible configuration, and many other arrangements could be used. In addition, in cases where the spa 10 is installed above the ground 16, an optional drainage line (not shown) originating at the lowest point of the reservoir 28 and terminating outside of the shell 18 may be included to assist in draining of the reservoir.

It will be noted that the coping 26 is considerably wider at one side of the spa 10 than any other. The coping 26 is enlarged in this area to provide an opening 42 leading to an equipment bay 44. The equipment bay 44 has two sections comprising an equipment compartment 46 and filtration compartment 48, both of which are located between the outer wall 20 and the internal reservoir 28. Preferably, the equipment compartment 46 and the filtration compartment 48 are in close proximity such that a single cover may be used to cover both. However, it is not a necessary requirement of this invention that the filtration compartment 48 and the equipment compartment 46 be located next to each other or that they share a common cover. Thus, a cover 50 for the equipment compartment 46 and a cover 51 for the filtration compartment 48 are shown. For convenience, both of these covers will be referred to as the cover 50.

Figure 13:
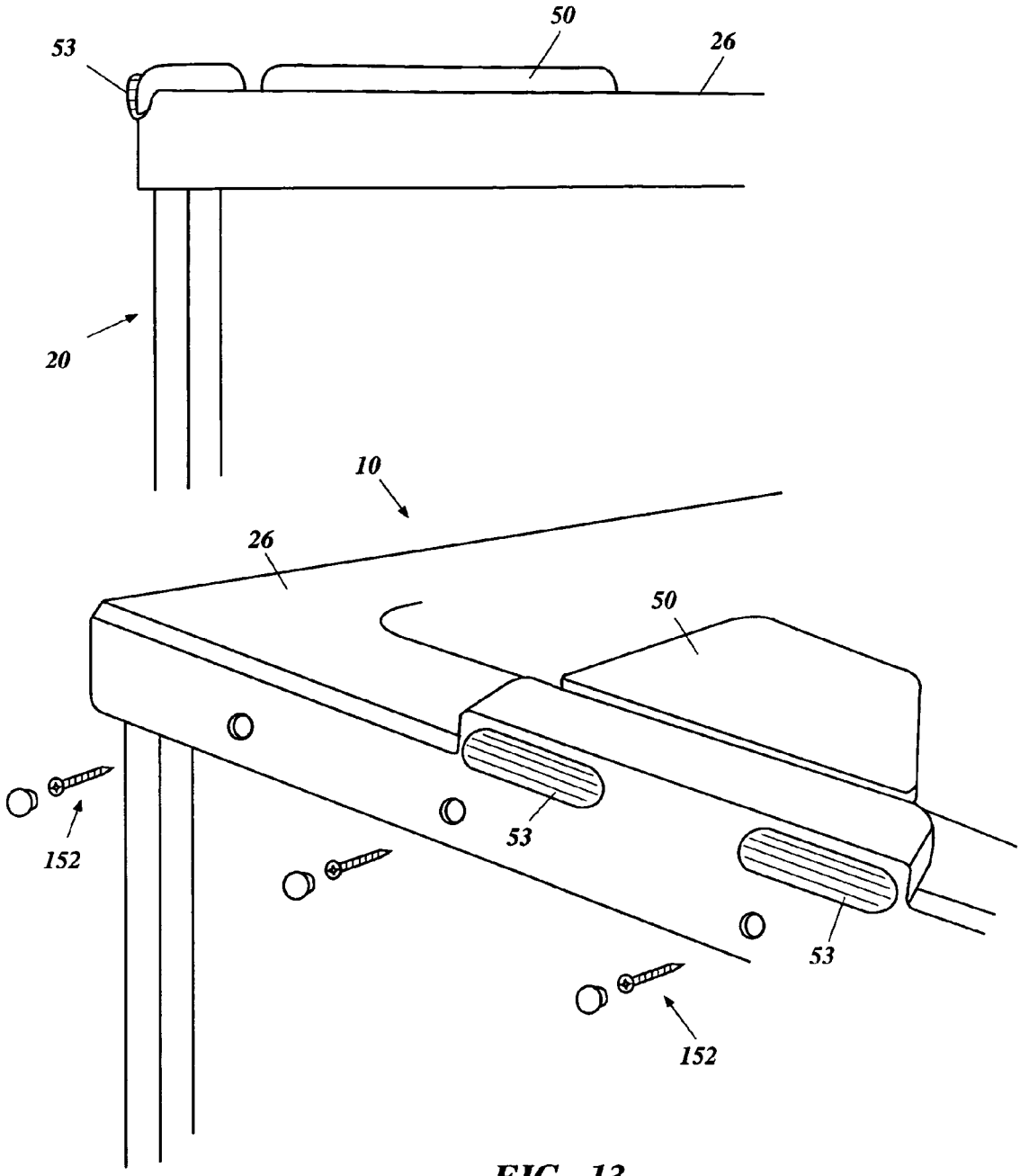
FIG. 13 illustrates a cover assembly in accordance with one embodiment of the present invention.

In one embodiment, as shown in FIG. 13, the cover 50 may be raised a distance from the top surface of the spa or remaining horizontal coping 26 along the upper surface of the spa 10. As shown in FIG. 13, the cover 50 typically provides access to at least some of the spa equipment including the sump pump. The raised cover 50, may provide, among other things, spa equipment with ventilation to cool the spa equipment during periods of operation and/or protection from water intrusion. In this regard, a raised cover 50 may be associated with vents 53 or similar type features that allow air to circulate around or near the spa equipment to dissipate heat that may build up due to operation of the equipment. In addition, raising the cover 50 will increase the interior space or inner area around the spa equipment capable of dissipating the heat as compared to the same interior area having a flat or lower positioned cover.

The raised cover 50 may also provide added protection to the spa equipment from the overflow of reservoir water caused by splashing and/or too many persons in the reservoir 28. Water overflow from the reservoir 28 may cause equipment failure due to corrosion and/or electrical malfunction. The raised cover 50 places any mating surface between the cover 50 and spa, and/or an opening used to grasp the cover 50, if provided, in a position that is less likely to encounter water from the reservoir 28 that may gain access to the spa equipment.

As will be understood by those skilled in the art, the raised distance of the cover 50 from the top surface or horizontal coping 26 will vary depending on, among other things, spa style and construction. In one example, the top of the cover 50 may be raised a distance of about an inch from the horizontal top coping 26. However, in another example, the top of the cover 50 may by be raised a distance of about a couple of inches from the horizontal top coping 26. At this height, the cover 50, in addition to the already mentioned purposes, may act as a dry seat for persons.

The cover 50 may be hinged, or removably attached such as with a pop-on cover or screw-on cover for example. As will be understood by those skilled in the art, the cover may be designed in a variety of shapes and sizes and will typically be constructed of a material similar to that used in the construction of the spa 10.

In an alternative embodiment (not shown), a damn, wall, or similar type border or margin may be positioned adjacent the access opening to spa equipment so as to minimize or prohibit reservoir water from entering into the opening. As described herein, the opening may provide access to equipment located in an inner space between the reservoir 28 and outer wall 20 of the spa 10. The damn may be of different heights depending, at least in part, on style and configuration of the spa, and the degree of protection from water intrusion desired. The damn may be used separately or with a raised cover 50 as described herein.

With particular reference to FIG. 2, the filtration compartment 48 includes a skimmer 52 that provides a water flow path from the reservoir 28 to the filtration compartment 48. Thus, the water level in the filtration compartment 48 is maintained essentially at the same level as that in the reservoir 28. Preferably, the lower edge of the skimmer 52 is just below the water level so that only water from the uppermost surface of the reservoir 28 can enter the filtration compartment 48. The skimmer 52 also preferably includes an inwardly hinged skimmer door 54 or the like that allows water and floating debris from the upper surface of the reservoir 28 to enter filtration compartment 48. In the event that a wave or backflow causes water from the filtration compartment 48 to flow back into the reservoir 28, the skimmer door 54 will be forced to close. Thus, floating debris that enters the filtration compartment 48 will remain trapped therein until the user removes it during a periodic cleaning. A filter cartridge 56 located near the bottom of the filtration compartment 48 serves to filter impurities in the water before it travels from the filtration compartment 48 through a pipe 58 and on to the equipment compartment 46. The filter cartridges 56 are removable so that they can be periodically cleaned or replaced.

Unlike the filtration compartment 48, the equipment compartment 46 is not flooded with water 12. It is isolated from the filtration compartment 48 and the reservoir 28 by a vertical wall 60. The equipment compartment 46 houses a conventional water pump 62 (or pumps as shown in FIG. 3), such as a motor-driven impeller-type water pump. It also houses a conventional water heater 66 for heating the water 12 and maintaining a desired water temperature within the reservoir 28. A control box 64 houses the necessary controls for controlling operation of the water pumps 62, the water heater 66 and any other necessary equipment. A sump pump 68 is located in the lower-most portion of the equipment compartment 46 and serves to remove any excess water that might leak or be splashed into the compartment 46 or, when installed in-ground, any water resulting from fluctuation in water table levels.

Figure 7:
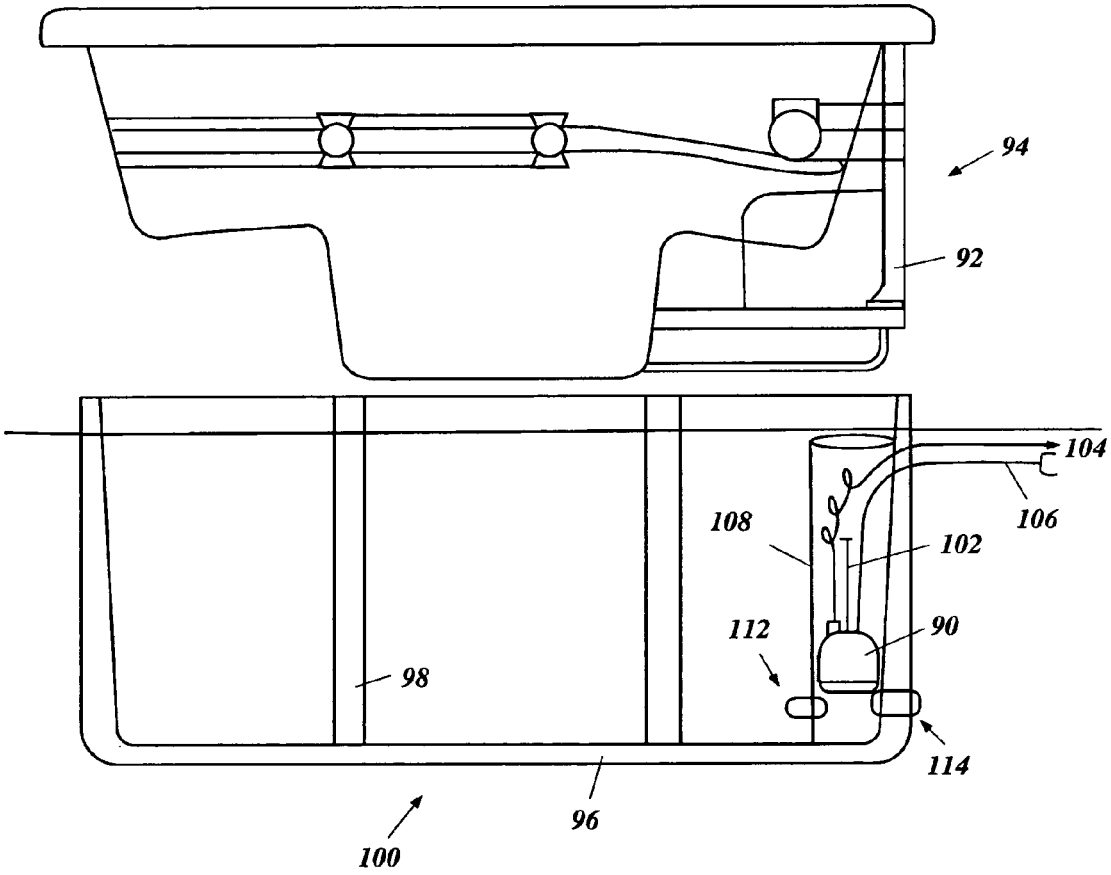
FIG. 7 is a side plan view of a reservoir (first section) and a cross-sectional view of an outer wall (second section) of a spa in accordance with one embodiment of the present invention.

As shown in FIG. 7, a sump pump 90 and other equipment may be located/positioned in the inner space 32 between the outer wall 20 and the reservoir 28. In this position, the sump pump 90 would facilitate the removal of any water that may enter into the inner space 32 between the outer wall 20 and reservoir 28 of the spa 10 due to a leak or break in the reservoir 28, hydro-jets and associated tubing, outer wall 20 and/or excessive ground water which may cause the spa 10 to pop out of the ground.

Figure 8:
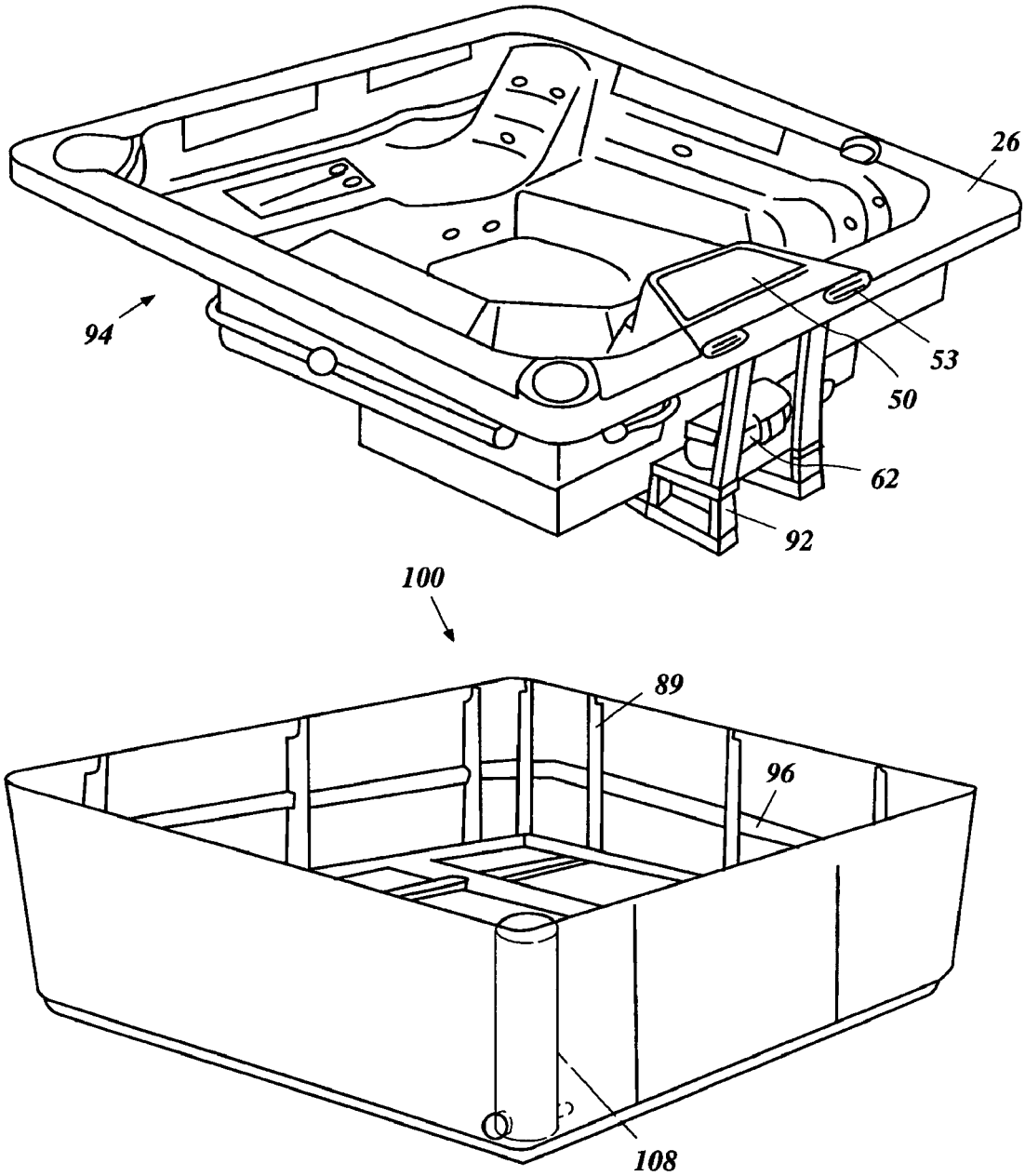
FIG. 8 is a perspective view of a reservoir (first section) and an outer wall (second section) of a spa in accordance with one embodiment of the present invention.

Spa equipment such as the water pump 62, water heater 66, and control box 64 may be positioned on a reservoir frame 92 located between the outer wall 20 and reservoir 28. As shown in FIG. 8, spa equipment accessibility is typically provided by a cover 50 located in the top surface of the spa 10. However, persons of ordinary skill in the art will understand that the actual positioning of these elements and/or others may vary depending on a variety of factors including spa design and configuration.

As shown in this below ground installation arrangement, the reservoir 28 and reservoir frame 92 preferably form a first section 94 of the spa 10 and horizontal and/or vertical support framework members 96, 98 preferably form a second section 100 of the spa. The second section 100 is adapted, through the use of the above mentioned horizontal/vertical support members 96, 98 and/or stiff insulating/packing material 34, to support the spa 10 against deformation from external forces such as lateral forces of the earth resulting from in-ground installation.

Returning now to FIG. 7, the first and second sections 94, 100 are joined together to form an inner space 32 between the first section 94 and second section 100. The sump pump 90 and its related fixtures (handle 102, discharge hose 104, power cord 106, etc.), and an associated sump pump housing 108 are typically positioned on the second section 100 such that when the first and second sections 94, 100 are joined together access to the sump pump 90 is provided by a lid 110, shown in FIG. 9, and/or cover 50.

Although the spa is described as having a first section 94 and second section 100, with certain manufacturing techniques the spa 10 may be manufactured as a single integral piece so that an inner space 32 is between a reservoir 28 for holding water and an outer wall 20 spaced outwardly from the reservoir 28. In this arrangement, the inner space 32 may be accessible from an opening at a top surface of the spa 10 with the inner space 32 adapted to contain equipment such as a water heater and water pump for operating the spa 10.

The basic construction, operation, and purpose of the sump pump 90 are consistent with sump pumps known in the art. In the present invention, the sump pump 90 or other similar type of water removal apparatus is typically associated with a first fluid path 112 and/or a second fluid path 114. As shown best in FIG. 9, the first fluid path 112 may be defined by a tube 116 constructed of plastic, rubber, or other similar type material positioned, at least in part, within the sump pump housing 108 so as to facilitate fluid communication between the inner space 32 and the sump pump 90. In this regard, the tube 116, if used, would pass through the sump pump housing 108. A valve, such as a check valve 118 or flapper valve (not shown), may be positioned within the tube 116 of the first fluid path 112 to provide one-way fluid communication from the inner spa space 32 to the sump pump 90.

In this regard, if any fluid should enter the inner space 32 due to a leak, break, or crack in the reservoir 28, hydro-jets and associated tubing, and/or outer wall 20 the fluid would be directed toward the sump pump 90 by the tube 116 of the first fluid path 112 where the fluid would be pumped by the sump pump 90 through the discharge hose 104 to some area away from the spa 10. Accordingly, any damage to the spa 10 or related equipment that may occur due to fluid infiltration will be minimized or eliminated entirely by the sump pump 90. Although a check valve 118 or similar device for controlling fluid flow is shown positioned along the tube 116 of the first fluid path 112, the check valve 118 may be integral with the sump pump housing 108 thus eliminating the tube 116. Accordingly, the sump pump housing 108 may be considered to form a part of the first fluid path 112.

The sump pump housing 108, typically constructed of material similar to the material used in the construction of the spa 10, may enclose the sump pump 90 (protecting it from damage) as well as providing a means of retaining fluid that is directed by the first fluid path 112 and/or second fluid path 114 to the sump pump 90. As such, in this arrangement, the sump pump housing 108 and check valve 116 would each act to prevent fluid, once inside the sump pump housing 108, from reentering into the inner space 32 where damage can result due to, among other things, equipment corrosion and electrical shorts. Specifically, the valve would act as a sort of door to allow fluid to enter near the sump pump 90 but would prevent any flow of fluid back into the inner space 32.

Figure 9:
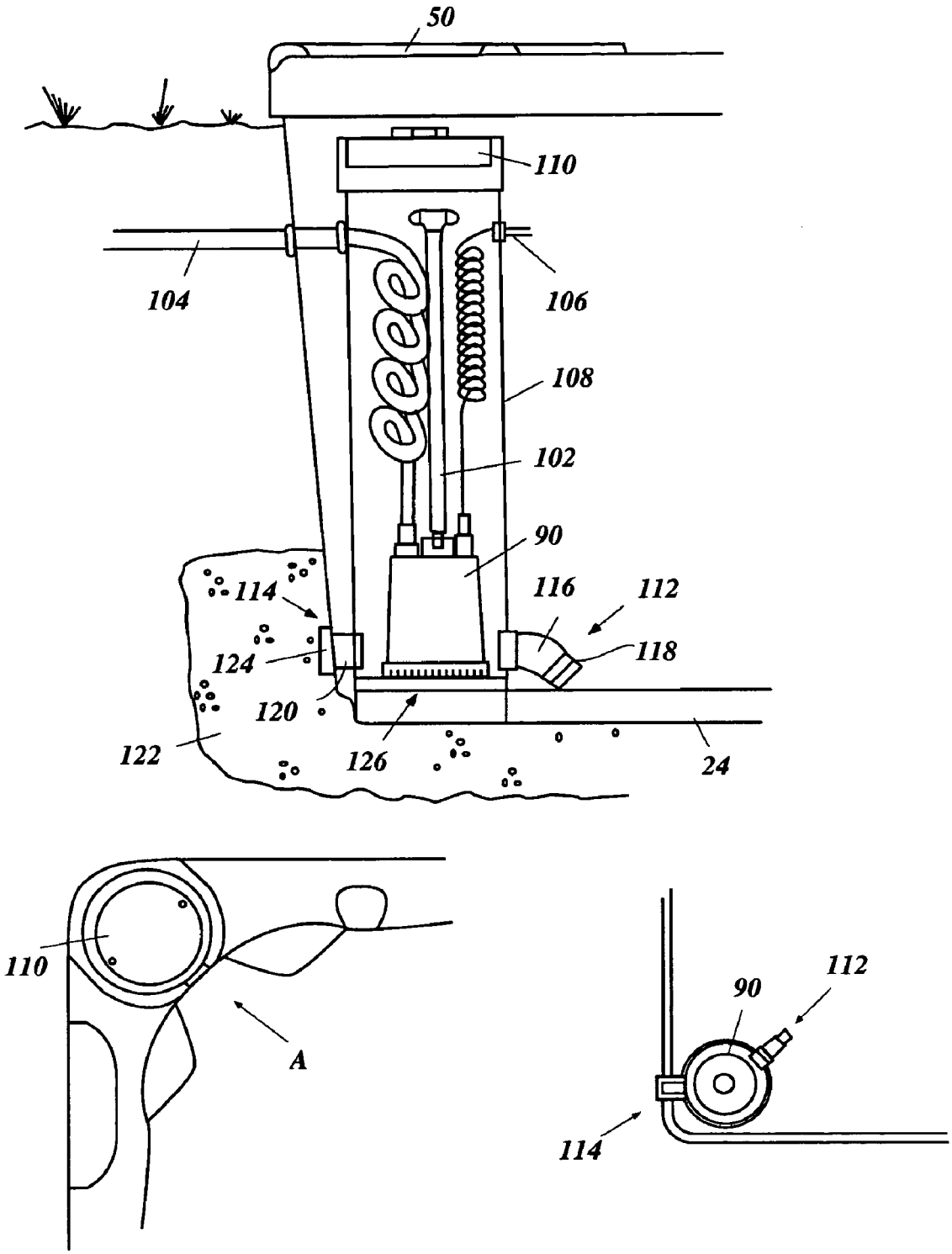
FIG. 9 is a cross-sectional view of a spa outer wall (second section) showing a sump pump housing and a sump pump in accordance with one embodiment of the present invention.

Typically, a removable cover, lid 110 or similar type of device will provide access to the sump pump 90. The cover or lid 110 may be solid or perforated and will typically be constructed of materials similarly to those used in the construction of the spa 10. A tube or similar device (not shown) may be connected to the lid 110 to permit venting of the sump pump housing 108. Once the cover or lid 110 is removed, access to the handle 102 is made available to remove the sump pump 90 from the inner space 32 for periodic maintenance or to facilitate use of the sump pump 90 for other purposes such as draining the spa 10. As shown in FIG. 9 the sump pump lid 110 may be used separately or with another cover 50 to gain access to the sump pump 90. If used separately, as shown by the sump pump corner configuration "A", the lid 110 will typically be located at the top surface of the spa 100 and sealed with a gasket or similar type device to protect against moisture intrusion.

The sump pump 90 may be associated with a second fluid path 114. Similar to the first fluid path 112, the second fluid path 14 may be defined by a tube 120 constructed of plastic, rubber, or other similar type material positioned within the sump pump housing 108 so as to facilitate fluid communication between the sump pump 90 and ground adjacent to the spa 10. In this manner, excessive ground water, for example, caused by heavy rains, too much lawn watering, improper and/or inadequate drainage around or near the spa 10, or other similar causes will be allowed to enter at the sump pump 90 where the fluid may be effectively and efficiently removed by the sump pump 90. As is well known in the art, excessive ground water adjacent, near, or around the spa 10 may cause the spa 10 to pop out of the ground. Therefore, in order to minimize or eliminate possible damage to the spa 10, area around the spa 10, wood deck, electrical connection, etc., and/or the need to reset the spa 10 into the ground, it is preferable that a monitoring and/or control system such as the present invention be in place to minimize or eliminate the possibility of spa pop out.

One end of the tube 120 defining the second fluid path 114 will typically be position in or adjacent to a level of gravel 122 near the bottom wall 24 of the spa 10. Typically, the end of the tube 120 nearest the gravel will further have a perforated grate or lid 124 positioned to allow fluid to pass through, but will prevent debris from entering into the inner space 32. During a heavy rain shower, ground water, which may cause the spa 10 to pop out of the ground, is allowed to flow pass the grate 124 toward the sump pump 90 by the tubing 120 of the second fluid path 114. At the sump pump 90, the fluid is then pumped through the discharge tube 104 to an area away from the spa 10 where it can be safely discharged without causing any damage to the spa 10.

In one embodiment, the sump pump housing 108 may be a separate removable element positioned in the inner space 32. Alternatively, a portion of the sump pump housing 108 may be integral with the outer wall 20 so as to be considered a single piece. As such, the grate 124 may be positioned flush with the sump pump housing 108. In this arrangement, although the sump pump 90 may be removed, the sump pump housing 108, formed as part of the second section 100 would not be removable.

Alternatively or in addition to the second fluid path 114 just described, a bottom wall grate or, as shown in FIG. 9, at least one perforation 126 in the sump pump housing 108 may be provided to permit water to pass from the ground adjacent the spa 10 through the perforation(s) 126 to the sump pump 90. In this arrangement, a portion of the sump pump housing 108 may be positioned within a bottom wall 24 of the spa 10 so as to facilitate fluid communication from ground adjacent the spa 10 through the perforation(s) 126 to the sump pump 90 when, for example, the water table rises sufficiently. Accordingly, ground water may be directed toward the sump pump 90 by the second fluid path 114 and/or a sump pump housing 108 entrance route defined by at least one perforation 126 in the sump pump housing 108 to permit water to pass from ground adjacent to the spa 10 through the preforation(s) to the sump pump 90.

The second fluid path 114 and/or at least one perforation of the sump pump housing 108 may or may not be used along with the first fluid path 112. Typically, if used with the first fluid path 112, the second fluid path 114 will not be equipped with a one-way valve so as to facilitate a possible additional avenue for the removal of fluid that may enter the inner space 32 from the reservoir 28, and/or hydro-jets and associated tubing. For example, any overflow of water or other fluid resulting from a break in the reservoir 28 entering the inner space 32 that is not immediately removed by the sump pump 90 may be allowed to exit via the second fluid path 114 or perforation(s) in the sump pump housing 108 into the surrounding gravel 122 where it may either be directed away from the spa 10 or redirected back into the second fluid path 114 thereby providing at least one more chance for the sump pump 90 to remove the fluid via the discharge tube 104.

Figure 10:
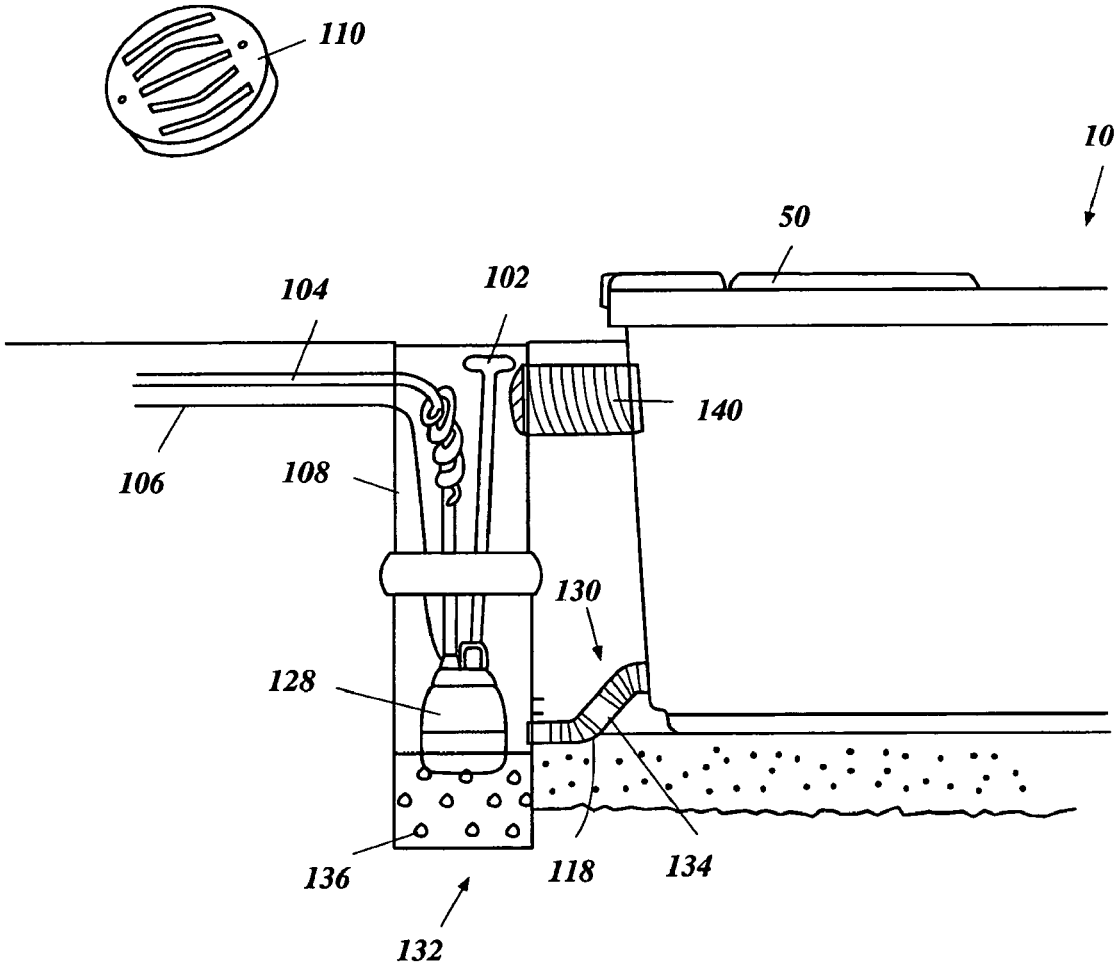
FIG. 10 is a cross-sectional view of a sump pump housing to show a sump pump positioned within the housing in accordance with another embodiment of the present invention.

In another embodiment, as shown in FIG. 10, a sump pump 128 may be positioned in the ground outside or external to the spa 10. In this position, the sump pump 128, as previously described, would facilitate the removal of any water that may enter into the inner space 32 between the outer wall 20 and reservoir 28 of the spa 10 due to a leak or break, in the reservoir 28, hydro-jets and associated tubing, outer wall 20 and/or excessive ground water which may cause the spa to pop out of the ground.

Similar to the sump pump just described, the externally positioned sump pump 128 will again typically be associated with a sump pump housing 108 or similar type of enclosure to protect the sump pump 128 from various types of damage. The sump pump 128 will likewise typically be associated with a first fluid path 130 and/or a second fluid path 132. As shown best in FIG. 10, the first fluid path 130 may be defined by a tube 134 constructed of plastic, rubber, or other similar type material that is intended to facilitate fluid communication between the inner space 32 and the sump pump 128. A valve, such as a check valve 118, may be positioned within the tube 134 of the first fluid path 130 to provide one-way fluid communication from the inner space 32 and the sump pump 128.

A second fluid path 132, associated with the sump pump 128, is intended to facilitate fluid communication between the ground adjacent to the spa 10 and the sump pump 128. In this manner, excessive ground water, for example, caused by heavy rains, too much lawn watering, improper/inadequate drainage around or near the spa, or other similar causes will be allowed to enter at the sump pump 128 where the fluid may be effectively removed by sump pump 128.

As shown in FIG. 10, the second fluid path 132 may be defined by at least one perforation 136 in the sump pump housing 108 which would allow ground water to enter the sump pump housing 108 near the sump pump 128. When the water enters the sump pump housing 108 the sump pump 128 may be automatically turned on to pump the fluid through the discharge tube 104 to some area away from the spa 10 where it can be safely discharged without causing any damage to the spa 10.

The power wires 106 for operating the sump pump 128, and the discharge tube 104 will typically be routed respectively to a power source and an area some distance from the spa 10 where fluid removed from the spa 10 can be safely discharged. The embodiment may also include a cooling or air vent 140, positioned between the sump pump housing 108 and the spa 10, to vent heat away from the inner spa space 32 during operation of spa equipment or to provide an air passage for the sump pump 128. As described herein, the cooling vent 140 may be connected to vents 53, used in addition to vents 53, or as an alternative to the vents 53 that may be provided in the cover 50. A vented cap or lid 110, similar to the lid used for the sump pump housing when positioned in the inner space 32, may also be positioned on the exterior positioned sump pump housing 108 to provide access to the sump pump 128. This vented cap or lid 110 may also serve to allow surface water to drain into the sump pump housing 108 where it can be pumped through the discharge tube 104 away from the spa 10 by the sump pump 128.

Figure 11:
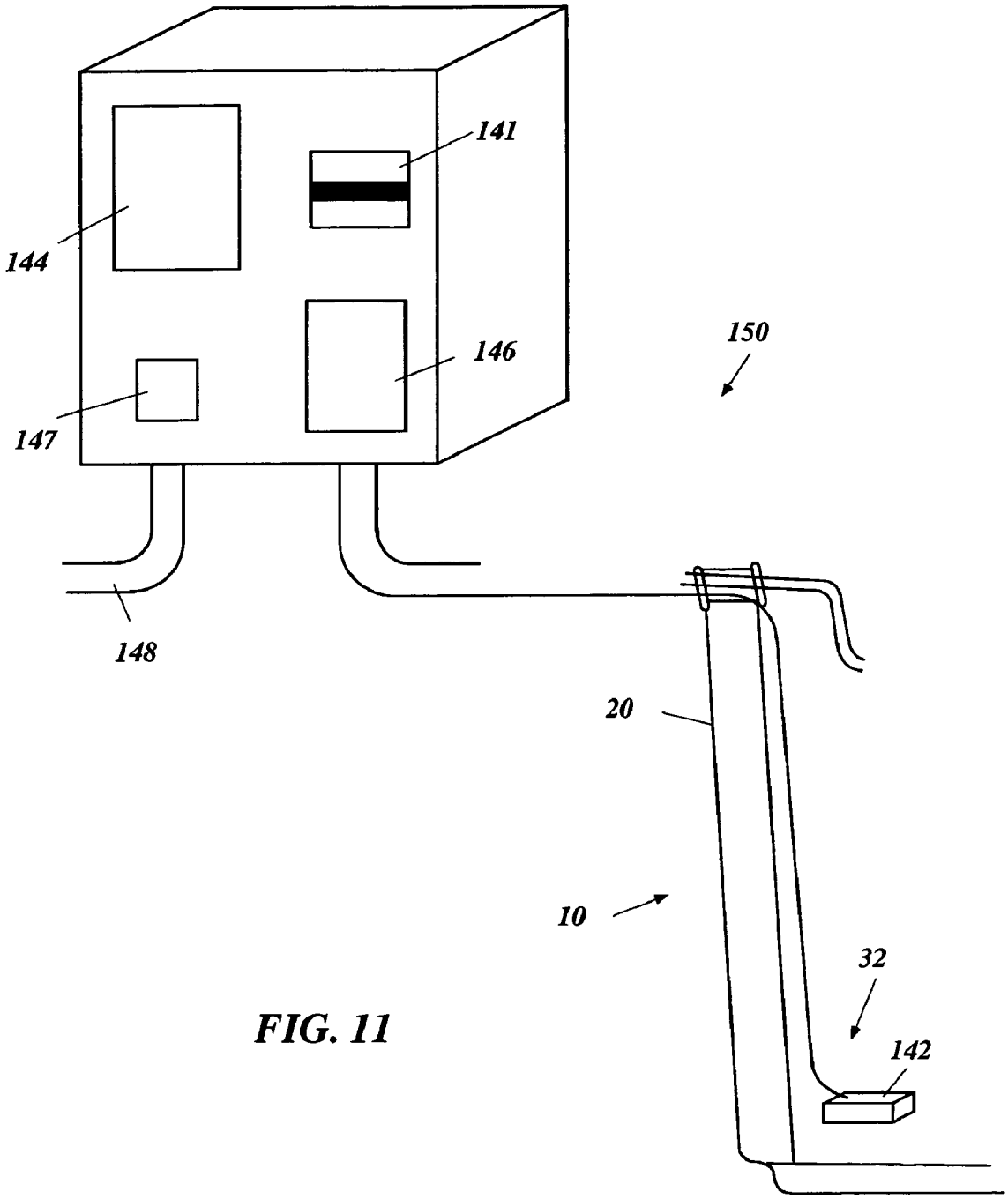
FIG. 11 illustrates a fluid detection system in accordance with one embodiment of the present invention.

Power 148 to operate the water pump 62 and the water heater 66 is supplied from an external electrical source (not shown) through a conventional hookup that may be located just below the edge of the coping 26. In one embodiment, as shown in FIG. 11, a fluid detecting system 150 may be positioned to detect fluid in the inner space 32 of the spa 10. The fluid detection system 150 may include a fluid activated sensor 142 connected to a ground-fault circuit interrupter (GFCI) 144. The sensor 142 may be positioned substantially in the bottom of the inner space 32 between the outer wall 20 and reservoir 28 so as to detect any fluid in the inner space 32. As is known in the art, a GFCI 144 is an electrical device that detects an (imbalance) of electrical current and reacts immediately by quickly interrupting the current flow. In this regard, the sensor 142 will detect any water that may enter into the inner space 32 due to a leak or break in the reservoir 28, hydro-jets and associated tubing, and/or outer wall 20 and shut down electrical power to spa equipment other than the sump pump 90 via activation of the GFCI 144. In this manner, any potential damage or harm to the spa equipment and/or to persons in or near the spa 10 due to water induced equipment malfunction or electrical shock will be minimized or eliminated as electrical connectivity to the spa 10 from the external power source will be interrupted.

Figure 12:
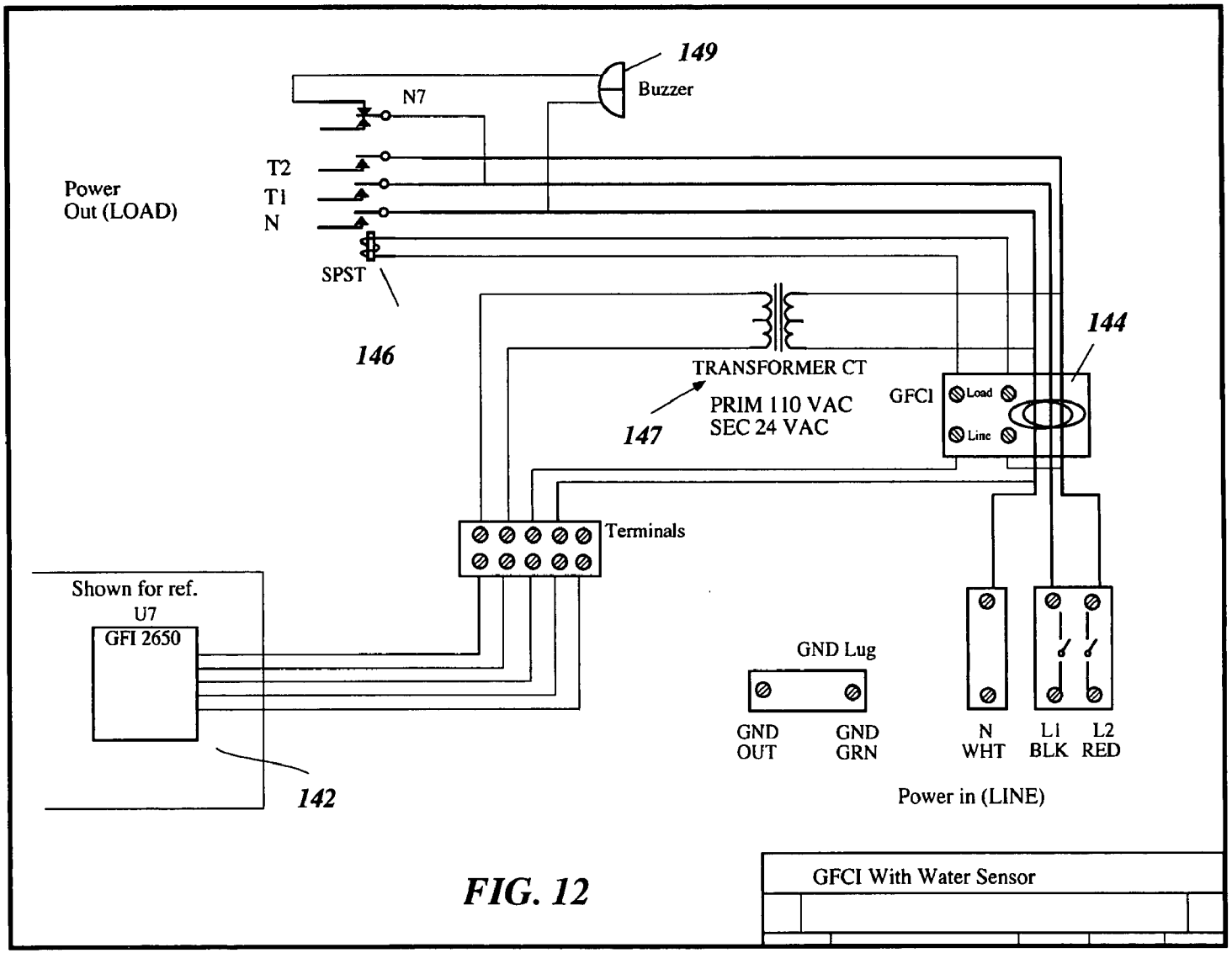
FIG. 12 is a schematic representation of the fluid detection system of FIG. 11.

In one embodiment or arrangement, as shown in FIG. 11 and schematically in FIG. 12, the GFCI 144 may be connected to a contactor 146, a transformer 147, and to a sensor 142 positioned in the inner space 32. Once a current imbalance or mismatch is detected, the sensor 142 activates the GFCI 144 which in turn activates the contactor 146 to disconnect power to spa 10. In this manner, a GFCI 144 having a low current or voltage rating may interrupt the higher current or voltage rated external power circuit 147, required to operate the spa, by activating a contactor 146 which functions as a circuit interface or step-up between the GFCI 144 and the external circuit. An alarm, buzzer 149, LED or other similar type device may be used to signal or otherwise indicate that power to the spa 10 has been interrupted and/or a problem exists.

In an alternative embodiment, both the detection of fluid in the inner space 32 and interruption of power to the spa equipment may be provided by the GFCI. In other words, the sensor may be contained within the GFCI to form a single integral unit (not shown) that may be positioned such that the detection of water and interruption of power to the spa is done by a single unit. In addition, an optional quick disconnect 141 may be added to allow persons to manually shut down or interrupt power to the spa 10.

Similarly, a GFCI (not shown) may independently be associated with a sump pump, as described herein. In this case, the GFCI associated with the sump pump would monitor any current imbalance or electric fault due to the operation of the sump pump and interrupt sump pump function accordingly. Typically, a separate circuit will be dedicated to each of the spa and sump pump GFCIs. For example, if a leak is detected in the inner space 32, electrical power will be interrupted to the spa equipment. The sump pump, however, will continue to be operational to remove any water associated with the leak. Likewise, is there is a ground fault or other condition that causes the GFCI associated with the sump pump to activate, the spa equipment will typically continue to be operational so that persons may enjoy the spa while the defective in the sump pump is corrected.

Retuning now to FIG. 2, the water pump 62 draws water from the reservoir 28 into the filtration compartment 48 and into the water heater 66 through an intake pipe 70. After passing through the heater 66, the water 12 is returned to the reservoir 28 by an output pipe 72 that distributes the heated water to the one or more hydro-jets located in various positions around the sides of the reservoir 28. The intake and output pipes 70 and 72 are preferably constructed of polyvinylchloride, but could also be made of other lightweight, noncorrosive materials. If it is desired to create a low-maintenance water treatment in the reservoir 28, a feature traditionally associated with spas of this type, the output pipe 72 may also include an ozone generator (not shown) that mixes ozone gas with the water flow before it enters the spa 10.

Figure 4:
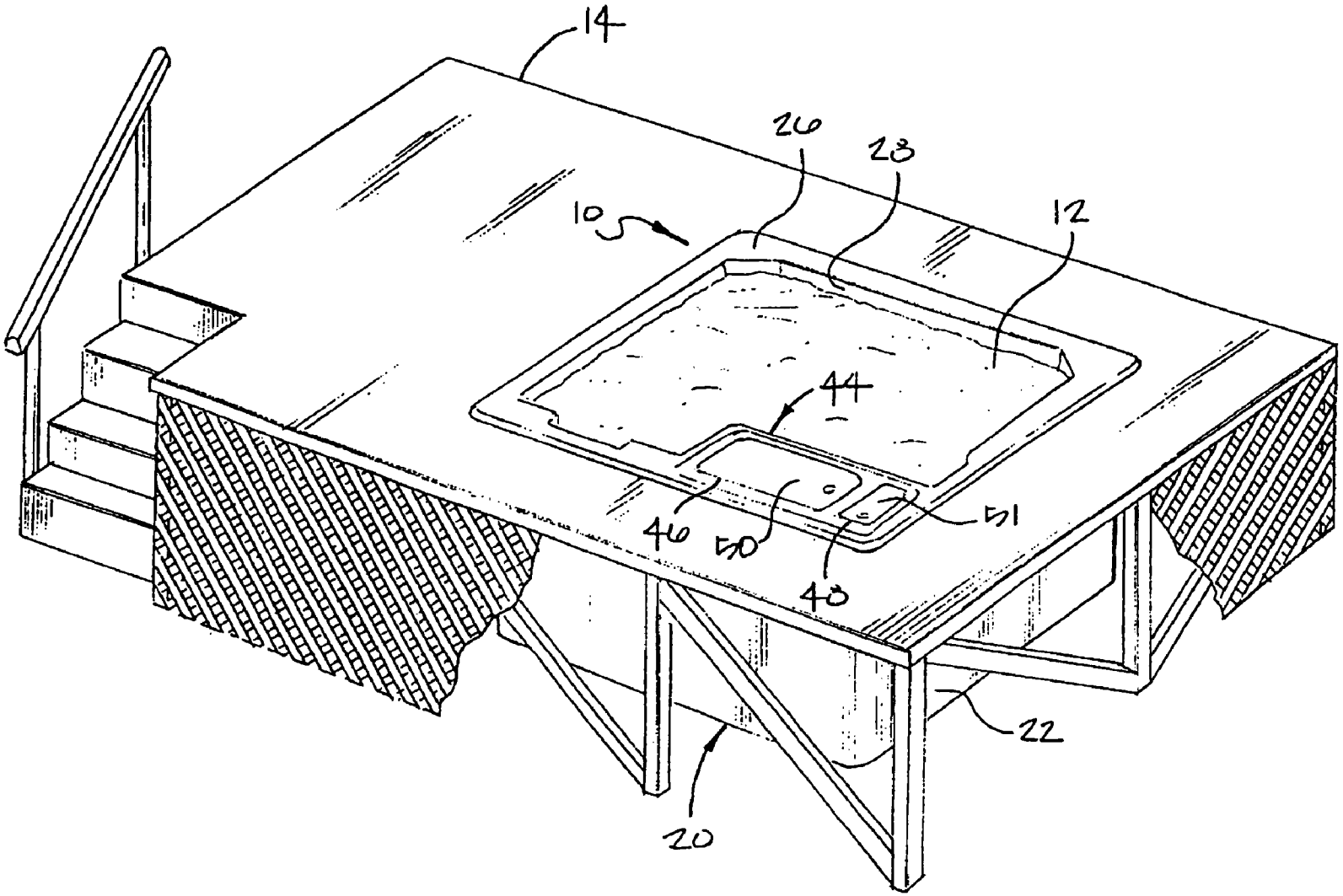
FIG. 4 is a perspective view of the spa installed above the ground with a raised deck surrounding the spa.

In accordance with the invention, the spa 10 may be installed above ground level, in the manner of a portable spa or, alternatively, it may be installed below ground level, in the manner of a permanently installed in-ground spa. If above-ground installation is desired, as shown in FIG. 4, one simply needs to place the spa 10 on a firm and level area (such as on a concrete pad or hard-packed earth), fill the reservoir 28 with water 12, and connect the power source. Since the side walls 22 of the spa are typically several feet high, an elevated deck 14 may also be built around the spa 10 to improve accessibility and appearance. Many variations of decks will serve this purpose.

Importantly, the elevated deck 14 does not require an equipment access door, either in the side or on the top of the deck, in order to gain access to the equipment bay 44. This is because all of the equipment in the equipment compartment 46 and the filtration compartment 48 can be conveniently reached by removing the cover 50 at the top of the spa 10. Hence, unsightly and potentially unsafe access doors in the deck 14 are avoided, as is the extra expense to make them. Moreover, the ease with which the equipment bay 44 can be reached is substantially enhanced. This is no need to crawl under the deck 14 through a side access door, or down through an access door in the top of the deck.

When the spa 10 is to be installed below ground level, as shown in FIGS. 1–2, a hole just slightly larger than the spa must be excavated. Once the spa 10 is placed in the hole, which may be as deep as the edge of the coping 26, some of the earth 16 that was excavated may be replaced directly around the walls of the spa, thus locking the spa into place. The reservoir 28 can then be filled with water 12 and the power source can be connected.

Importantly, no retaining wall or other type of barrier needs to be installed to keep the earth 16 away from the side walls 22 of the spa 10. Further, since the spa 10 is a self-contained unit having all of the necessary equipment to operate the spa, there is no need for additional excavation for plumbing, such as output pipes or hydro-jets. Again, only the power source needs to be connected, and since it is located just below the edge of the coping 26, it also does not require additional excavation. Thus, the spa 10 may be easily installed in areas where space is limited, and it may be installed in virtually any orientation desired by the user.

Furthermore, even though the entire side wall 22 of the spa 10 is buried underground, access to the equipment bay 44 is easily and conveniently accomplished through the top access cover 50 in the coping 26. Consequently, there is no need to build a retaining wall or the like around the spa 10 before it is placed in the hole. However, if the appearance of an in-ground spa is desired, and the user wishes to keep the option to move the spa 10 in the future, such a conventional retaining wall could be built. Advantageously, since the equipment bay 44 is accessible at the top of the spa 10, only a small clearance is necessary between the spa side wall 22 and the retaining wall.

When the spa 10 is installed above-ground level, there will be some lateral forces against the walls comprising the reservoir 28 and the outer wall 20 of the shell 18. For example, the weight of the water 12 in the reservoir 28 creates an outward lateral pressure against the reservoir walls and contributes to the overall weight of the spa 10 and thus the forces exerted on the side wall 22 supporting the spa.

Even more significant, however, is the lateral pressure against the outer wall 20 caused by the earth 16 when the spa 10 is installed directly in the ground. If the reservoir 28 is empty for a significant time, this lateral inward pressure could cause substantial damage or buckling of the walls without a counteracting support system. Accordingly, the present invention provides a reinforcing means to prevent this damage.

FIG. 5 illustrates one embodiment of a reinforcing means comprising an internal support framework 74 which provides the necessary structural support to enable the side wall 22 of the spa 10 to resist the subjacent lateral forces of the earth 16 resulting from in-ground installation. The support framework 74 comprises a plurality of supports such as pressure treated wood. Other suitable supports, such as supports made from rigid plastic material, also can be used.

The support framework 74 is located in the space 32 between the reservoir 28 and the outer wall 20 and comprises bottom horizontal supports 76, top horizontal supports 78 and vertical supports 80 extending between and connecting the top supports 78 to the bottom supports 78. Triangulation of the vertical supports 80 is accomplished by braces 82 having one end connected either to a vertical support 80 or a top horizontal support 78 and having another end connected to a corresponding horizontal bottom support 76.

A dense foam or similar lightweight, high-strength material 34, discussed above, may also be used as a filler between the outer wall 20 and the reservoir 28 to increase the structural integrity as well as the insulation capacity of the spa 10. In this regard, it is contemplated that an appropriate filler 34 with the requisite structural strength and other characteristics could be used alone to support the spa 10, without requiring the support framework 74 discussed above.

An alternative embodiment of the invention is illustrated in FIG. 6. In this embodiment, the equipment compartment 46 and the filtration compartment 48 are accessible from the side of the shell 18 through a side access door 84. A side shield 86 isolates and protects the side access door 84 from the surrounding earth 16 for an in ground installation. However, the excavated ground otherwise completely surrounds and abuts against the side wall 22 of the spa 10, as in the in-ground installation discussed above.

As shown in FIG. 13, connecting or joining together of the reservoir 28 and outer wall 20 or first and second sections 94, 100 may be facilitated by at least one above abutment-grade connecting member 152. The connecting member 152 joins mating surfaces between the first section 94 and second section 100. As shown in FIG. 13, connecting members 156 may be spaced around the perimeter of the spa 10. The exact location or positioning of the connecting members 156 will vary and depend, at least in part, on the style, size, and configuration of the spa 10. Typically, the connecting member 152 may be a screw, bolt, fastener or similar type device for securing or holding the first and second sections 94, 100 together.

Figure 14:
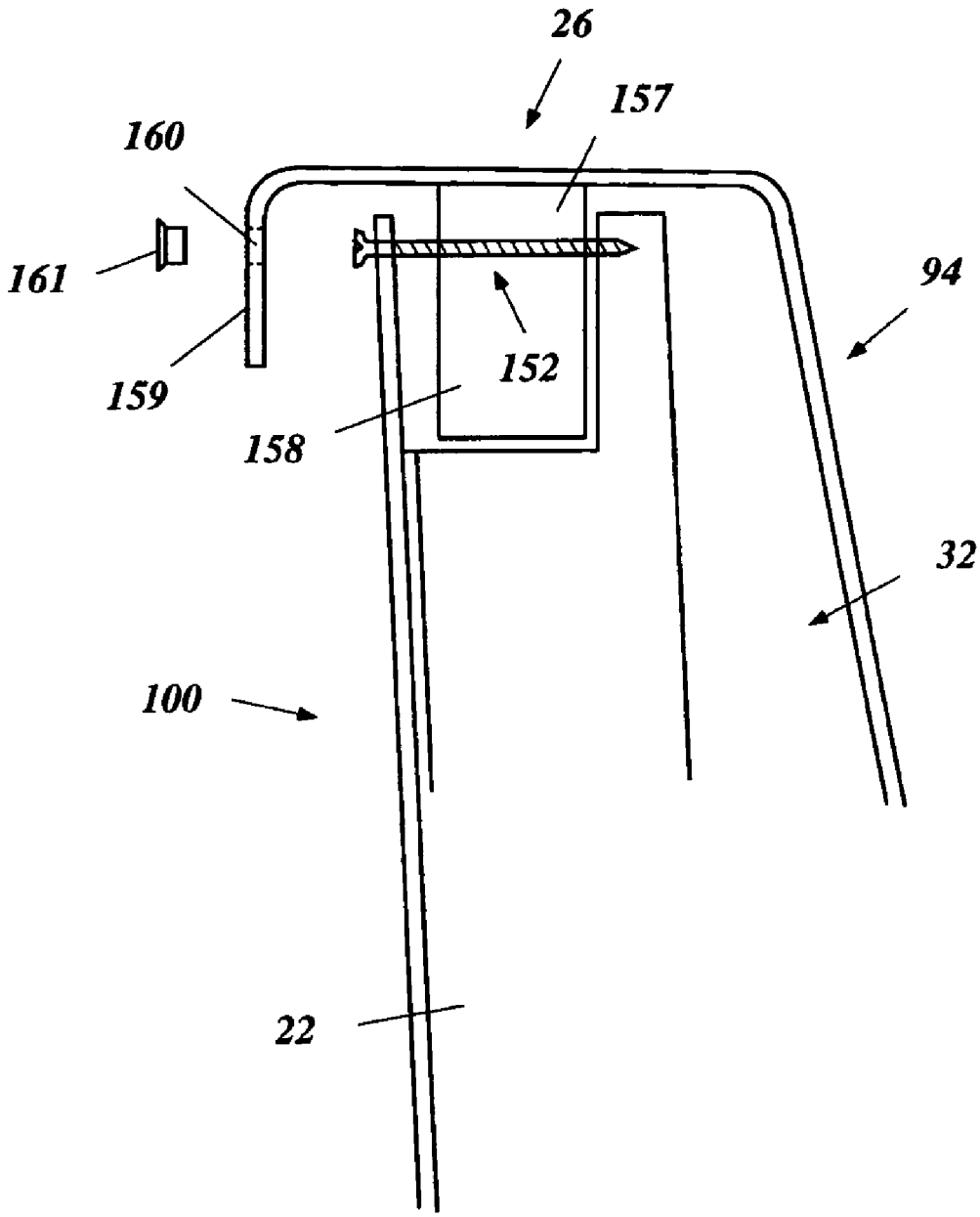
FIG. 14 is a cross-sectional view of an above abutment-grade connecting assembly in accordance with the present invention.

In one embodiment, the mating surfaces of the first and second sections 94, 100 may be male and female members 157, 158. As shown in FIG. 14, the first section 94 having a first mating surface 157 (male) is positioned adjacent to the second section 100 having a mating surface 158 (female) such that when the first and second mating surfaces 157, 158 are joined together the first and second sections 94, 100 are held securely in place by the connecting member 152. As will be understood by those skilled in the art, the mating surfaces between the first and second sections 94, 100 are not strictly limited to the male and female arrangement just described but may encompass a wide variety of mating configurations including a ball-and-socket type arrangement (not shown) that permits the first and second sections to be pushed or snapped together securely. In the aforementioned ball-and-socket arrangement, the connecting member, if used, would further secure the first section 94 to the second section 10 together. Likewise, it will be understood by those skilled in the art that first and second sections designated as either being male and female or ball and socket may be reversed while still deriving the benefits of the present invention.

Access to the connecting member 156 may be provided by a hole 160 in a flange 159 or lip around the first section 94. Among other things, the flange 159 provides an aesthetic touch to make an appealing transition from the top surface 26 of the spa 10 and, for example, the ground 16 and/or raised deck 14. As shown in FIGS. 1 and 4, typically the ground 16, raised deck 14, and/or other similar type abutment is typically flush with the lower edge of the flange 159. In this regard, the aforementioned abutments provide a grade or surface level with the lower edge of the flange 159. In order to separate the first and second sections 94, 100 of the spa 10, the aforementioned abutments must be removed and/or replaced, sometimes at a considerable expense.

As shown in FIG. 14, by providing an above abutment-grade connecting member 156 the present invention permits access to the connecting member 156 without the monetary expense and/or labor of having to remove and replace all or portions of the spa abutments such as the adjacent ground 16 and/or a raised deck 14. Removal of a cap 161 or similar type cover adapted to fit into the hole in the flange 159 permits the connecting member 152 to be insert through the hole 160 in the flange 159 where the connecting member 156 can facilitate the joining together of the first and second sections 94, 100 of the spa. Likewise, access to the connecting member 156 for separation or disassembly of the first and second sections 94, 100 requires only the removal of the cap 161. No time consuming, labor intensive, expense removal of the adjoining abutment is necessary with the above abutment-grade connecting assembly of the present invention.

From the foregoing, it will be appreciated that the present invention provides a universal self-contained spa 10 that can be installed either above ground or below ground level, while still providing a means to access the equipment necessary to service the spa. Access to the equipment is both convenient and safe, and the overall appearance of the spa 10 and its surrounding environment is as aesthetically pleasing as possible. The resulting spa is extremely versatile, as it may be portable or permanently installed at the option of the owner.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A pre-fabricated self-contained in-ground spa, comprising:

a first section for holding water;

a second section joined together with the first section to form an inner space between the first section and the second section, the inner space being accessible from an opening at a top surface of the spa, and adapted to contain equipment for operating the spa;

a sump pump housing; and a sump pump positioned inside the sump pump housing, the sump pump associated with a first fluid path passing through the sump pump housing, the first fluid path adapted to facilitate fluid communication between the inner space of the spa and the sump pump.

2. The spa of claim 1, wherein the sump pump housing is positioned in the inner space.

3. The spa of claim 2, wherein the first fluid path includes a check valve to prohibit fluid flow from the sump pump to the inner space.

4. The spa of claim 2, wherein the sump pump is associated with a second fluid path adapted to facilitate fluid communication between the sump pump and ground adjacent to the spa.

5. The spa of claim 2, wherein a portion of the sump pump housing is positioned within a bottom wall of the spa and includes at least one perforation to permit water to pass from ground adjacent to the spa through the perforation to the sump pump.

6. The spa of claim 1, wherein the sump pump housing is positioned external to the second section.

7. The spa of claim 6, wherein the first fluid path includes a check valve to prohibit fluid flow from the sump pump to the inner space.

8. The spa of claim 6, wherein the sump pump housing includes a vented cap to permit surface ground water to flow into the sump pump housing and to the sump pump.

9. The spa of claim 6, wherein the sump pump is associated with a second fluid path passing through the sump pump housing, the second fluid path adapted to facilitate fluid communication between the sump pump and ground adjacent to the sump pump housing.

10. The spa of claim 9, wherein the second fluid path includes at least one perforation in the sump pump housing to permit water to pass from the ground adjacent to the sump pump housing through the perforation to the sump pump.

11. A pre-fabricated self-contained in-ground spa, comprising:

a first section for holding water;

a second section joined together with the first section to form an inner space between the first section and the second section, the inner space being accessible from an opening at a top surface of the spa, and adapted to contain equipment for operating the spa; and a water removal apparatus comprising:

a sump pump housing; and a sump pump enclosed within the housing;

wherein the sump pump is associated with a first fluid path and a second fluid path, the first fluid path passing through the sump pump housing, the first fluid path adapted to facilitate fluid communication between an inner space of a spa and the sump pump, and the second fluid path adapted to facilitate fluid communication between ground adjacent to the sump pump housing and the sump pump.

12. The apparatus of claim 11, wherein the first fluid path includes a check valve to prohibit fluid flow from the sump pump to the inner space.

13. The apparatus of claim 11, wherein the sump pump housing includes a vented cap to permit surface ground water to flow into the sump pump housing to the sump pump.

14. The spa of claim 11, further comprising a fluid detection system positioned to detect fluid in the inner space of the spa, the detection system designed to interrupt power to the spa in response to the detection of fluid.

15. The spa of claim 14, where fluid is detected in the inner space and power is interrupted to the spa by a ground fault circuit interrupter.

16. The spa of claim 14, wherein the fluid is detected by a sensor positioned substantially in the bottom of the inner space, and the power to the spa is interrupted by a ground fault circuit interrupter in response to fluid detection by the sensor.

17. The spa of claim 11, wherein the water removal apparatus is located within the inner space.

18. The spa of claim 17, wherein the spa includes a damn adjacent the opening at the top surface of the spa to prevent water from entering into the inner space.

19. The spa of claim 17, wherein the spa includes a cover raised a distance from the top surface of the spa to facilitate access to the equipment for operating the spa.

20. The spa of claim 17, wherein a portion of the sump pump housing is positioned within a bottom wall of the spa, and the second fluid path includes at least one perforation in the sump pump housing to permit water to pass from ground adjacent to the spa through the perforation to the sump pump.

21. The spa of claim 11, wherein the water removal apparatus is positioned external to the spa.

22. The spa of claim 21, wherein the second fluid path includes at least one perforation in the sump pump housing to permit water to pass from the ground adjacent to the sump pump housing through the perforation to the sump pump.

* * * * *

UNITED STATES PATENT AND TRADEMARK OFFICE

CERTIFICATE OF CORRECTION

PATENT NO. : 7,020,910 B1
APPLICATION NO. : 10/701,220
DATED : April 4, 2006
INVENTOR(S) : Tim P. Horwood It is certified that error appears in the above-identified patent and that said Letters Patent is hereby corrected as shown below:

In column 1, line 34, "relative" should be --relatively--;
In column 6, line 1, the word "by" should be omitted;
In column 6, lines 11, 17 & 20, "damn" should be --dam--;
In column 7, lines 16 & 19, the number "98" should be --89--;
In column 8, line 38, "14" should be --117--;
In column 8, line 57, "position" should be --positioned--;
In column 8, line 64, "pass" should be --past--;
In column 10, line 50, "(imbalance)" should be --imbalance--
In column 11, line 34, "is" should be --if--;
;In column 11, line 34, "defective" should be --defect--;
In column 12, line 6, "This" should be --There--;
In column 12, line 45, after the word "exerted", insert --outwardly--;
In column 12, line 67, the second number "78" should be --76--;
In column 13, line 53, "10" should be --100--;
In column 13, lines 38 and 30, "156" should be --152--;
In column 14, lines 5, 6, 13, and 15, "156" should be --152--;
In column 14, line 17, “expense” should be --expensive--;
In column 15, line 37, "apparatus", should be --spa--;
In column 16, line 1, "apparatus", should be --spa--; and
In column 16, line 19, "damn" should be --dam--.

Signed and Sealed this

Fifth Day of September, 2006

JON W. DUDAS
*Director of the United States Patent and Trademark Office*